US008579021B2

(12) United States Patent
Kuehne et al.

(10) Patent No.: US 8,579,021 B2
(45) Date of Patent: Nov. 12, 2013

(54) HEAT EXCHANGER

(75) Inventors: Heinrich J. Kuehne, Huntersville, NC (US); Thomas Cott, Cornelius, NC (US)

(73) Assignee: Hydac Cooling GmbH, Sulzbach/Saar (DE)

( * ) Notice: Subject to any disclaimer, the term of this patent is extended or adjusted under 35 U.S.C. 154(b) by 307 days.

(21) Appl. No.: 12/923,905

(22) Filed: Oct. 13, 2010

(65) Prior Publication Data

US 2012/0073793 A1 Mar. 29, 2012

(30) Foreign Application Priority Data

Sep. 29, 2010 (DE) ..... 10 2010 046 913

(51) Int. Cl.
*F28F 3/00* (2006.01)
*F28F 7/00* (2006.01)

(52) U.S. Cl.
USPC ..... 165/166; 165/167; 165/76

(58) Field of Classification Search
USPC ..... 165/165, 166, 167, 76
See application file for complete search history.

(56) References Cited

U.S. PATENT DOCUMENTS

| | | | | |
|---|---|---|---|---|
| 3,252,510 | A * | 5/1966 | Blankenhorn | 165/166 |
| 3,601,185 | A * | 8/1971 | Rothman | 165/166 |
| 4,681,155 | A * | 7/1987 | Kredo | 165/76 |
| 4,729,428 | A | 3/1988 | Yasutake et al. | |
| 4,934,455 | A * | 6/1990 | Hasegawa | 165/166 |
| 6,019,169 | A * | 2/2000 | Ruppel et al. | 165/166 |
| 6,520,252 | B1 * | 2/2003 | Bizzarro | 165/166 |
| 8,276,654 | B2 * | 10/2012 | Zaffetti et al. | 165/166 |

FOREIGN PATENT DOCUMENTS

| | | |
|---|---|---|
| DE | 595190 | 4/1934 |
| DE | 196 51 625 | 6/1998 |
| DE | 202 08 748 | 10/2003 |
| DE | 103 47 677 A1 | 5/2005 |
| DE | 20 2008 013 351 U1 | 3/2010 |
| EP | 0 203 458 A1 | 12/1986 |
| EP | 0 292 968 A1 | 11/1988 |
| WO | WO 2005/036082 | 4/2005 |

* cited by examiner

*Primary Examiner* — Tho V Duong
(74) *Attorney, Agent, or Firm* — Roylance, Abrams, Berdo and Goodman LLP

(57) ABSTRACT

A heat exchanger, in particular for fluid cooling devices, has a package of plane-parallel plates (1) with flow regions (3, 5) for a hot medium and for a cooling medium alternatively between pairs of plates (1) lying on top of one another. Each region is laterally bordered by profile strips (7, 11) keeping the plates (1) at a distance and forming solder surfaces (25) adjoining the plates (1). The profile strips (7, 11) on the flow regions (3, 5) extend along edges of the plates (1) and abut one another at an angle. The profile strips (11) of the flow regions (5) of the cooling medium having a base body (13), two legs (17) extending from the base body along the solder surfaces (25), and a recess (15) between the legs open toward the adjacent flow region (5). The recess (15) at least in the region adjacent to its inner end segment (23) is bordered by planar wall parts (29).

9 Claims, 2 Drawing Sheets

HEAT EXCHANGER

FIELD OF THE INVENTION

The invention relates to a heat exchanger, in particular for fluid cooling devices, having a package of plane-parallel plates. Flow regions for a hot medium and for a cooling medium are formed in alternation between pairs of plates lying on top of one another. Each flow regions is laterally bordered by profile strips keeping the plates at a distance and forming solder surfaces adjoining the plates. The profile strips on the flow regions of one medium and of the other medium extend along edges of the plates abutting one another at an angle. At least the profile strips of the flow regions of the cooling medium have a base body and two legs extending from the base body along the solder surfaces. Between the legs, a recess is open toward the adjacent flow region.

BACKGROUND OF THE INVENTION

Heat exchangers of this type, referred to as finned radiators, are prior art as shown in DE 20 208 748 U1. These heat exchangers are often used with air as the cooling medium for cooling of hydraulic fluids for the working hydraulics of mechanical systems, such as construction machinery or the like, for hydrostatic drives, or as oil coolers for highly loaded gear trains, specifically for wind power plants. In the operation of such systems, the heat exchangers are exposed not only to mechanical loads, but, due to the high operating temperatures of fluids to be cooled, in particular also to thermal loads. Especially when temperature jumps arise due to intermittent operating modes, as a result of material strain, serious stresses in the package of components joined into a rigid block by soldering can occur. The consequences are stress cracks, especially in the area of the solder seams, causing the risk of failure of the heat exchanger and endangerment of the pertinent system.

SUMMARY OF THE INVENTION

An object of the invention is to provide a heat exchanger characterized by improved resistivity to operating loads so that reliable long-term operation is enabled.

This object is basically achieved according to the invention by a heat exchanger where that the shape of the cross section bordering the solder surfaces is optimized to avoid undue stresses by special shaping of the recess at least of the profile strips bordering the cooling medium. Starting from the inner end section, the recess has planar wall parts. An at least more or less linear change of the bending strength over the length of the profile legs can be achieved so that optimum bending behavior of the legs can be attained by the choice of the length and/or tilt of these planar wall parts relative to the plane of the solder surface.

Especially advantageously, the recess, starting from its inner end section, has diverging first planar wall parts extending to constrictions of the cross section of the legs, converging second planar wall parts adjoining the constrictions, and third planar wall parts adjoining the second planar wall parts and extending parallel to the solder surfaces into the vicinity of the opening of the recess. In this way, on the profile legs, areas of lower bending strength are formed connected on both sides to leg segments in which the bending resistance increases essentially linearly. The constrictions define not only a bending line of the flector type, but also represent the site of the steepest temperature gradient. Since the steepest temperature gradient takes effect at the site of the smallest material cross section, correspondingly small material strains and stresses arise.

In especially advantageous exemplary embodiments, the recess is shaped such that fourth planar wall parts extend slightly diverging to one another as far as the opening of the recess adjoining the third planar wall parts.

Preferably, the first planar wall parts can form planes perpendicular to one another, and the second planar wall parts can include an obtuse angle with the first planar wall parts, which angle is preferably slightly larger than a right angle. Thus, the cross-sectional shape of the recess in the region bordering the inner end corresponds more or less to a square open toward the opening.

Advantageously, the first planar wall parts are connected to one another and to the second planar wall parts by arched wall sections with the same radius of curvature. The second planar wall parts are connected to the third planar wall parts, and the third planar wall parts are connected to the fourth planar wall parts, preferably, also by arched wall sections with the same second radius of curvature which is twice the first radius of curvature.

With respect to the dimensioning of the constrictions relative to the cross-sectional thickness of the legs following in the direction to the opening, is preferably the thickness of the cross section of the legs in the region of the third planar wall parts is roughly twice the thickness of the cross section at the constrictions.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
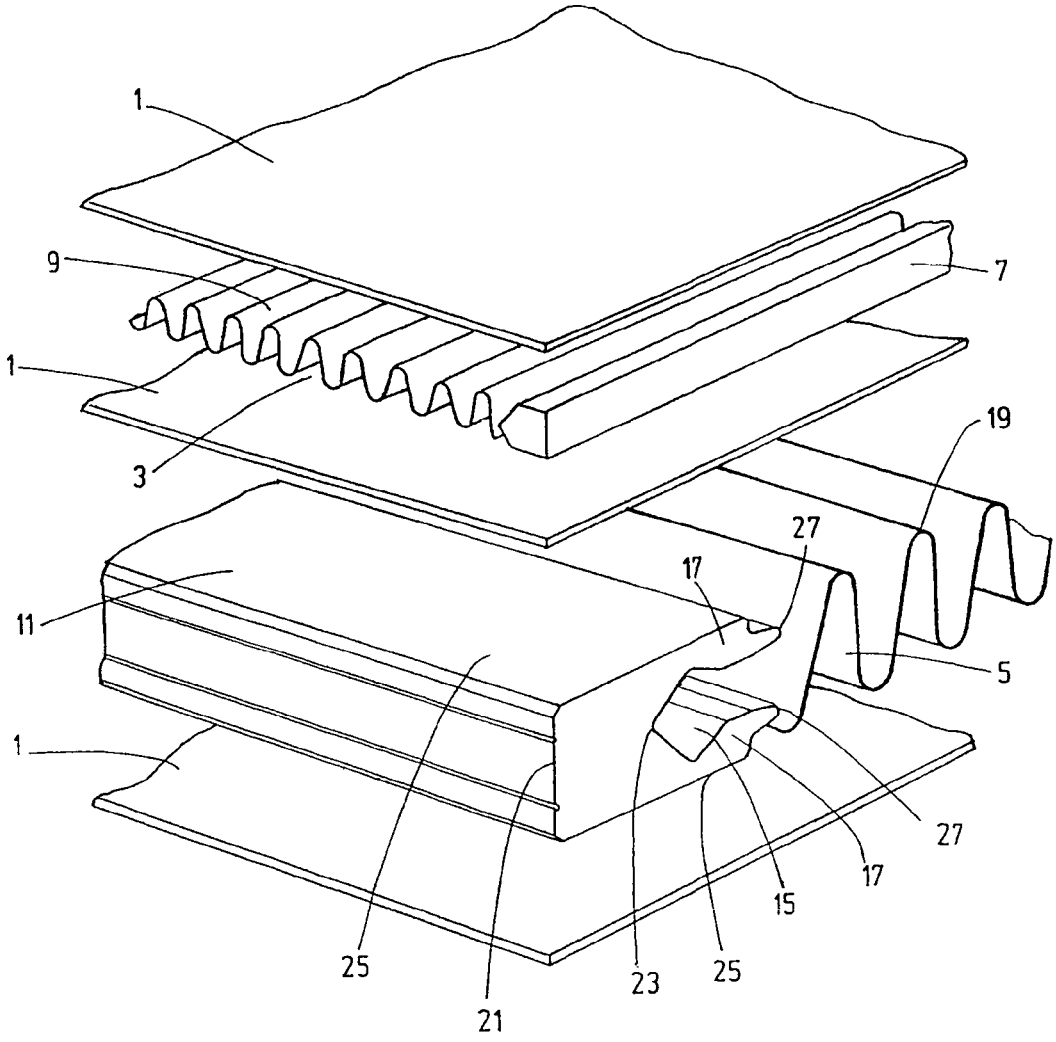
FIG. 1 is a partial exploded perspective view of only one corner region of one part of the plate package of a heat exchanger according to an exemplary embodiment of the invention.

FIG. 1 illustrates one exemplary embodiment in the form of a heat exchanger manufactured in the conventional plate design with a stack of flat plates 1, preferably of an aluminum alloy, extending in parallel planes and forming separating plates for the flow regions located between them. Between each succeeding pairs of plates, one flow region 3 for the medium to be cooled, for example, hydraulic oil, and one flow region 5 for a cooling medium, for example, cooling air, are formed in alternation. As is apparent from FIG. 1, the flow regions 3 and 5 extend at a right angle to one another. The flow region 3, shown at the top in the drawings, for the hot medium is closed on two opposite sides by cover strips 7 of conventional design. Between covers strips 7, the respective inflow and outflow region is located and, conventional turbulators 9 are provided in the form of fins.

Figure 2:
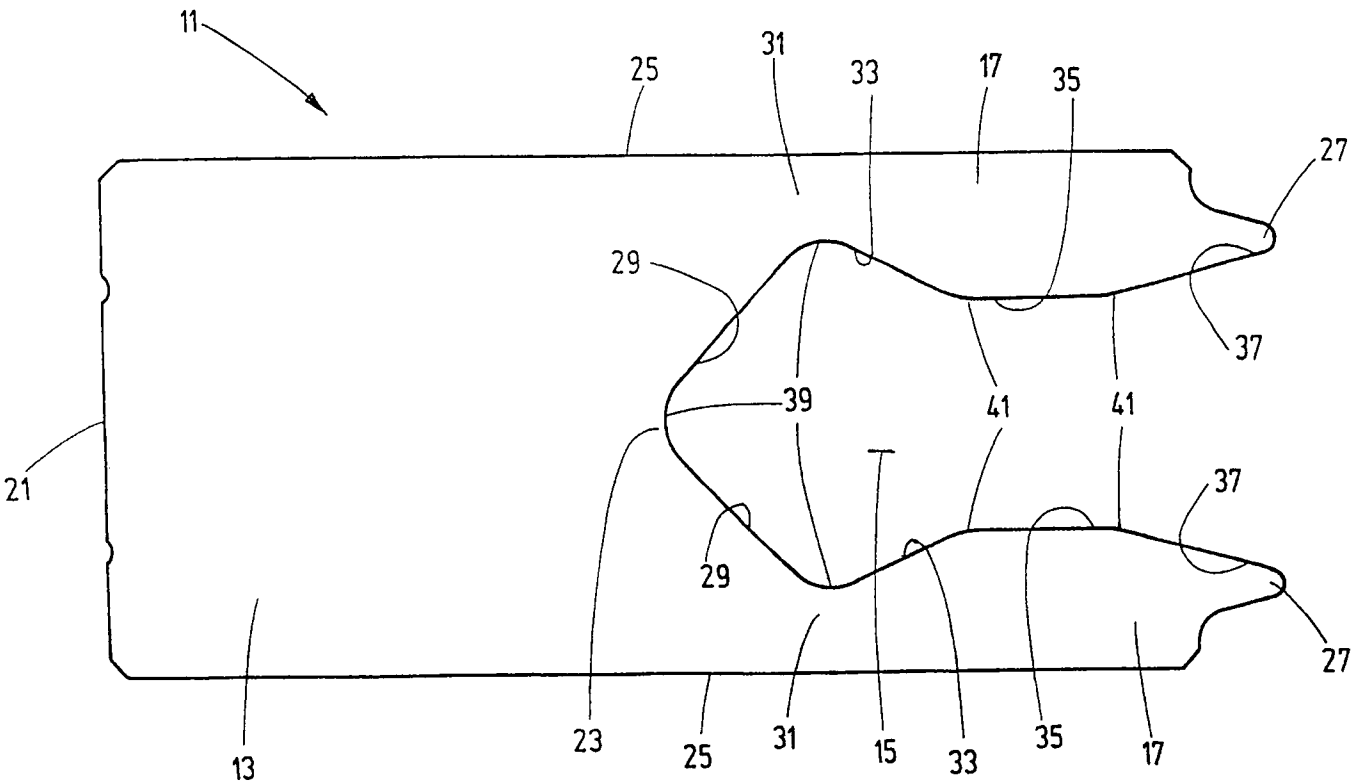
FIG. 2 is an enlarged side elevational view of only one profile strip for forming a spacer between the plates of the package of FIG. 1.

The flow region 5 of the cooling medium is likewise bordered laterally by cover strips forming the spacers between the respective pair of plates and being made as profile strips 11 with a special configuration according to the invention. This design according to the invention is detailed using FIG. 2.

As is apparent, the profile strips 11, likewise preferably extruded from an aluminum alloy, have a square or block-shaped base body 13 facing the edge region of the plates 1. A recess 15 in the form of a continuous longitudinal groove is bordered by legs 17 on both sides of recess 15. As FIG. 1 shows, the recess 15 is open toward the flow region 5 in which cooling fins 19 are located. Fins 19, analogous to the turbulators 9 in the flow region 3, enlarge the effective heat transfer surface. The inner end section 23 (FIG. 2) of the recess 15 is located at a distance from the closed end 21 of the profile strip 11, which distance is somewhat greater than the distance between the end section 23 and opening of the recess 15. The flat upper and lower end surfaces of the profile strip 11, that is to say, from the base body 13 to the end region of the legs 17, form the solder surfaces 25 for connecting the plate package. Lip-like projections or lips 27 are on the open end of the recess 15. As FIG. 1 shows, the lips 27 support the fins 5 in front of the end of the solder surfaces 25, so that the danger that fin ends will penetrate into the gap between the plate 1 and solder surface 25 is avoided in stack formation.

The recess 15, starting from its inner end segment 23, is bordered by first planar wall parts 29. Planar wall parts 29 diverge, include a right angle to one another, and extend into the vicinity of the pertinent solder surface 25 and forming thereof a profile constriction 31 of the profile cross section of the legs 17. The constriction 31 is adjoined by second planar wall parts 33 converging to one another and include an obtuse angle slightly larger than a right angle with the first planar wall parts 29. The length of these second planar wall parts 33 is somewhat less than the length of the first planar wall parts 29. These second planar wall parts 33 are followed by third planar wall parts 35 defining planes parallel to the solder surfaces 25 extending into the vicinity of the opening of the recess 15. These third planar wall parts are in turn followed by fourth planar wall parts 37 which extend slightly diverging to one another as far as the opening of the recess 15. The connection of the first planar wall parts 29 to one another and to the second planar wall parts 33 takes place by arched wall sections 39 with the same radius of curvature. The connection of the second planar wall parts 33 to the third planar wall parts 35 and the connection or the third planar wall parts 35 to the fourth planar wall parts 37 likewise takes place by arched wall sections 41 in which the radius of curvature is twice the radius of curvature at the wall sections 39.

The cross-sectional shape of the recess 15 provided according to the invention results in an effective reduction of operating stress peaks and the risk of crack formation at the solder sites. When the coolant is flowing through the recess 15, the constrictions 31 on the leg profile form the site of the steepest temperature gradient. At the same time, this site is also the location of the smallest material cross section so that thermal deformations are limited to correspondingly limited material portions. Since the profile thickness of the legs 17, starting from the constrictions 31, toward the opening, increases to a profile thickness corresponding roughly to twice the value at the constrictions 31, an optimum stress distribution over the region of the solder surfaces 25 is achieved.

The heat exchanger according to the invention need not be limited to the field of fluid cooling, but can also be used in general for cooling of gaseous media and can include in particular charge-air coolers (diesel engines) as well as after-coolers and intercoolers (compressors). The temperature differences (cooling air to the medium) in these applications are comparatively much higher than described in the foregoing.

While one embodiment has been chosen to illustrate the invention, it will be understood by those skilled in the art that various changes and modifications can be made therein without departing from the scope of the invention as defined in the appended claims.

What is claimed is:

1. A heat exchanger, comprising:

a package of plane-parallel plates;

hot medium flow regions and cooling medium flow regions in an alternating arrangement between respective pairs of said plates and lying on top of one another; and hot medium and cooling medium flow regions in an alternating arrangement between respective pairs of said plates and lying on top of one another; and hot medium and cooling medium profile strips laterally bordering said hot medium flow regions and said cooling medium flow regions, respectively, and maintaining adjacent plates at a distance relative to one another, said profile strips having solder surfaces adjoining the respective plates, extending along edges of the respective plates and abutting respective ones of on another at angles, each of said cooling medium profile strips having a base body, two legs extending from said base body and a recess between said legs thereof, each said recess having an opening toward and adjacent the respective cooling medium flow region and having an inner end section, starting from each said inner end section each recess having diverging first planar wall parts extending to constrictions of cross sections of said legs thereof, converging second planar wall parts adjoining the respective constrictions and third planar wall parts adjoining the respective second planar wall parts and extending parallel to the respective solder surfaces into a vicinity of said opening of the respective cooling medium profile strip.

2. A heat exchanger according to claim 1 wherein each said recess has fourth planar wall parts diverging relative to one another as far as said opening thereof and adjoining the respective third planar wall parts.

3. A heat exchanger according to claim 1 wherein said first planar wall parts in each said recess form planes perpendicular to one another.

4. A heat exchanger according to claim 1 wherein said second planar wall parts in each said recess include obtuse angles with the respective first planar wall parts.

5. A heat exchanger according to claim 1 wherein said first planar wall parts are connected to one another and to the respective second planar wall parts in each said recess by arched wall sections with a same first radius of curvature.

6. A heat exchanger according to claim 5 wherein each said recess has fourth planar wall parts diverging relative to one another as far as said opening thereof and adjoining the respective third planar wall parts.

7. A heat exchanger according to claim 6 wherein said second planar wall parts are connected the respective third planar wall parts and said third planar wall parts are connected to the respective fourth planar wall parts by arched wall sections with a same second radius of curvature, said second radius of curvature being twice said first radius of curvature.

8. A heat exchanger according to claim 1 wherein a thickness of a cross section of each said leg in a region of the respective third planar wall part is approximately twice a thickness of the respective leg at said constriction thereof.

9. A heat exchanger according to claim 1 wherein said hot medium flow region conveys a fluid.

* * * * *